United States Patent [19]

Kugler et al.

[11] Patent Number: 4,727,345

[45] Date of Patent: Feb. 23, 1988

[54] CONTACT ARRANGEMENT FOR LOW VOLTAGE CIRCUIT BREAKER WITH A FLEXIBLE CURRENT LEAD

[75] Inventors: Reinhard Kugler; Bernd Rambotzki, both of Berlin, Fed. Rep. of Germany

[73] Assignee: Siemens Aktiengesellschaft, Munich, Fed. Rep. of Germany

[21] Appl. No.: 909,216

[22] Filed: Sep. 18, 1986

[30] Foreign Application Priority Data

Oct. 7, 1985 [DE] Fed. Rep. of Germany ..... 3536112

[51] Int. Cl.[4] ..... H01H 1/58; H01H 33/00; H01H 9/02

[52] U.S. Cl. ..... 335/196; 200/144 R; 200/237; 335/200

[58] Field of Search ..... 200/6 R, 237, 238, 284, 200/271–274, 144 R, 304, 305; 335/196–200, 202

[56] References Cited

U.S. PATENT DOCUMENTS

| | | | |
|---|---|---|---|
| 3,200,228 | 8/1965 | Locher | 200/294 |
| 3,280,287 | 10/1966 | Ellsworth et al. | 200/147 R |
| 4,638,277 | 1/1987 | Thomas et al. | 335/200 X |

FOREIGN PATENT DOCUMENTS

| | | |
|---|---|---|
| 1220923 | 7/1966 | Fed. Rep. of Germany . |
| 193538 | 3/1923 | United Kingdom . |

*Primary Examiner*—J. R. Scott

[57] ABSTRACT

A contact arrangement for a low-voltage circuit breaker comprises a pivotally mounted holder for two or more contact levers which are connected by flexible current leads to a fixed connecting device or connecting bar. Between the current leads, a spacer is arranged which comprises, besides a wall portion separating the current leads, lateral projections of pocket or tub-shaped form. The projections provide a seating surface for a leg of the current lead bent in loop form as well as a protective arch contiguous with the seating surface for protecting any damaged sheets of the current leads. The spacer comprising an insulating material, is provided with an opening for a joint pin provided for the pivotable suspension of the holder.

5 Claims, 3 Drawing Figures

CONTACT ARRANGEMENT FOR LOW VOLTAGE CIRCUIT BREAKER WITH A FLEXIBLE CURRENT LEAD

BACKGROUND OF THE INVENTION

The present invention relates to a contact arrangement for low-voltage circuit breakers with a pivoted holder for a movable switching lever which is connected to a fixed connection point by a flexible current lead.

A contact arrangement of this kind has become known, for example, through DE-A- No. 1,220,923. Here, in a multi-pole circuit breaker, for each pole a holder with a movable switching lever and a flexible current lead is provided. If, taking this as point of departure, a low-voltage circuit breaker for a higher nominal current is to be developed, the usual method can be followed of providing for each pole, not one, but two or more identical contact levers with respective current leads in a common holder. On these parts, in parallel spatial arrangement and traversed by parallel currents, current forces act which remain without harmful consequences as long as a sufficient distance exists between the parts, as the forces are dependent on the distance. But if the distance is to be as small as possible, as is stipulated for the construction of compact and yet efficient switches, considerable forces must be expected, which most readily affect the parts of greatest mobility. This includes, in particular, the flexible current leads, which precisely in view of least impediment of the mobility of the contact levers, are made as flexible as possible. The current leads are made, for example, of layers of thin copper sheets hardened by rolling, joined at their ends by welding, soldering or other suitable methods. As the current forces act crosswise to the stacking of the sheets, the latter may break or be deformed at their points of attachment, and this may lead to increasing temperature rise and finally to damage to and failure of the circuit breaker.

SUMMARY OF THE INVENTION

Taking this as point of departure, it is an object of the present invention to permit as small as possible a distance between the current leads without loss of their mobility, thus contributing to the provision of a compact and efficient contact arrangement.

The above and other objects of the present invention are achieved by a contact arrangement for a low-voltage circuit breaker with a pivotally mounted holder for a movable switching lever which is connected by a flexible current lead to a fixed connecting point, wherein the arrangement is provided with two or more parallel current paths per pole and an insulating spacer is supported fixedly arranged between the current leads.

According to the invention, the insulating spacer is supported on the holder between the current leads, with a parallel arrangement of two or more current leads per pole. This spacer supports the adjacent current leads and thereby prevents too strong a bending force under the influence of the attracting forces acting at high currents. Due to the application of the spacer on the holder, the relative movements between the current leads and the spacer remain small.

Costly means for applying the spacer are avoided according to a variant of the invention in that, by an opening, the spacer is movably mounted on the journal forming the pivot bearing of the holder. At the same time, with this arrangement the spacer can be given especially small dimensions, this being favorable for the size and weight of the spacer.

Further, the spacer may have a bearing surface for each current lead and an abutment surface for limiting the mobility of the spacer relative to a fixed counterpiece. It is achieved thereby that, if designed in the form of loops, the current leads cannot deflect unhindered under the action of the current forces, such that the current forces become active only at one leg of each current lead. This can be utilized for the purpose of exerting on the contact levers a force which compensates the contact-lifting forces. Via the abutment surface this force braces itself against the holder of the contact arrangement.

Further, through a protective arch contiguous to the abutment surface, the spacer may be given the form of a pocket, in order on the one hand to protect the current leads and, on the other hand, to catch individual sheets of the current leads should they have been broken under extreme stress on the circuit breaker. It is prevented in this manner that the sheets bend far away from the current lead and come in contact with grounded parts of the circuit breaker.

BRIEF DESCRIPTION OF THE DRAWINGS

In the following, the invention will be explained more specifically with reference to the embodiment illustrated in the figures, in which.

DETAILED DESCRIPTION

Figure 1:
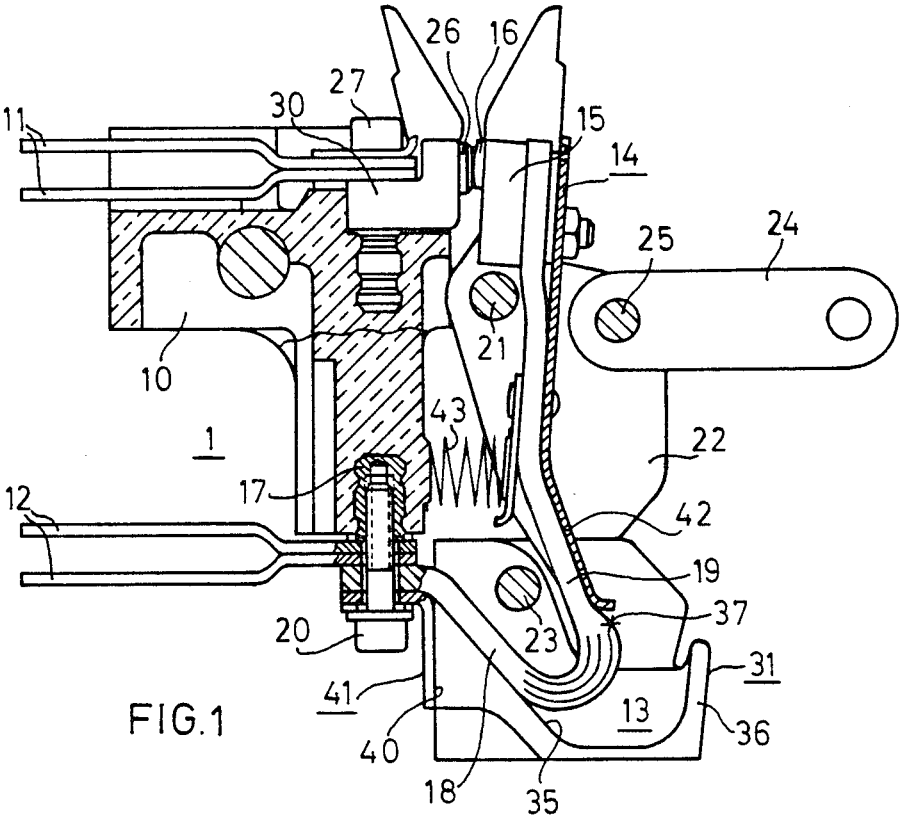
FIG. 1 shows the current path of a pole of a low-voltage circuit breaker, partly in cross-section.

The contact arrangement of the present invention is shown in FIG. 1 generally by reference numeral 1.

The current path shown in FIG. 1 comprises an insulation part 10 as carrier of an upper forked connecting bar 11 and of a lower, also forked connecting bar 12. In conductive connection with the latter is a flexible current lead 13, which forms the current supply to a contact lever 14 shown in section. The current lead 13 extends to a contact support 15, on which there is a contact 16. To establish a clamping connection between the connecting bar 12 and the current lead 13, the insulation support 10 contains a pressed-in threaded bushing 17, into which is screwed a clamping screw 20 traversing the current lead 13 and the connecting bar 12. The contact lever 14 is mounted pivotably about a joint pin 21 on a support 22, which in turn can pivot about a journal 23. By a drive lever 24, which in a manner not shown in detail is in connection with a drive device and which engages at a joint pin 25 traversing the support 22, the support 22 is swiveled with the contact 26 which is applied on a contact support 30 also attached by clamping screw 27 on the insulation support 10. By the clamping screw 27 the contact support is conductively connected with the upper connecting bar 11.

As FIG. 1 shows, the current lead 13 is loop shaped in its lower region, embracing the bearing pin 23 of holder 22. A current flowing through the current lead 13 thus causes forces which act in the sense of expanding the loop, that is, which strive to move the legs 18 and 19 of the current lead 13 apart. Further, attracting forces occur between the current lead 13 visible in FIG. 1 and a similar additional current lead lying in the plane of the drawing before or behind the current lead 13. Due to this, not only can these current leads get into an undesired conducting connection with one another, but also the thin sheets of which the current leads consist may be subjected to strong mechanical stress especially at their clamping points or coupling points.

A deformation of this kind is prevented by a spacer 31, which covers the loop region of the current lead 13 with the legs 18 and 19. The wall portion 32 of the spacer 31 lying between the current leads (FIGS. 2 and 3) has a passage opening 33, which is provided for passage of the bearing pin 23 of the holder 22. By an appropriate overdimension of the passage opening 33 provision can be made that inevitable manufacturing tolerances cause no difficulties in installation and that a certain mobility of the space 31 relative to holder 22 exists. Contiguous to the wall portion 32 on both sides is a more or less arc-shaped projection 34, resulting in a pocket-like form, as can be seen especially from FIGS. 1 and 2. On their side toward the current leads, the projections 34 form a seating area 35, which acts as an area type support for the leg 18 of each current lead 13, as FIG. 1 shows. Contiguous to the seating areas 35, the projections 34 have a protective arch 36, which extends at a distance from the respective current lead 13 such that movement is not impeded. The protective arch 36 is dimensioned so that a sheet of the current lead 13 breaking, for example, at the point marked 37, is prevented from extending downward, being instead caught and completely enclosed by the protective arch 36. Contact of such a damaged sheet with voltage-carrying parts is thus prevented.

As has been mentioned before, a current flowing through the current lead 13 creates forces which strive to cause a spreading of the legs 18 and 19. These forces can be purposely utilized to compensate contact-lifting forces between the contacts 16 and 26 by the same current, in that they are introduced in a suitable manner into the contact lever 14 acting as a two-armed lever. To this end the spacer 31 has an abutment surface 38 which cooperates with a fixed counter-surface 40 which is a component part of an angle-piece 41 also gripped by the clamping screw 20. Force exerted on the seating surface 35 by leg 18 of current lead 13 is thus braced relative to the insulation support 10. As a result, the force occurring in the current loop acts fully on leg 19 of current lead 13, which leg in turn applies force against a suitably formed wall 42 of the contact lever 14. Thereby a torque is produced about the joint pin 21 acting in the same sense as a compression spring 43 arranged between the insulation support 10 and the contact lever 14.

Figure 2:
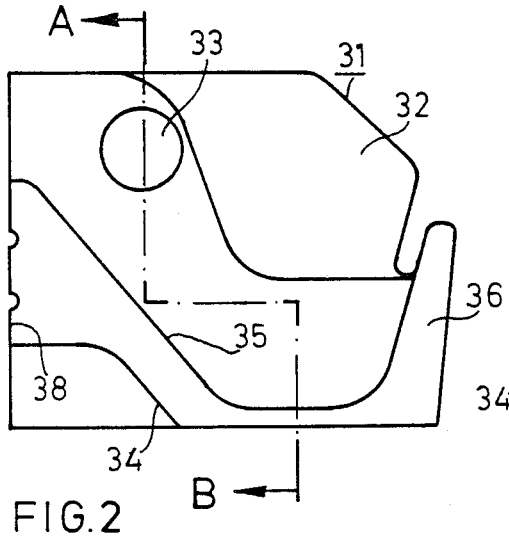
FIG. 2 illustrates a spacer in detail.
Figure 3:
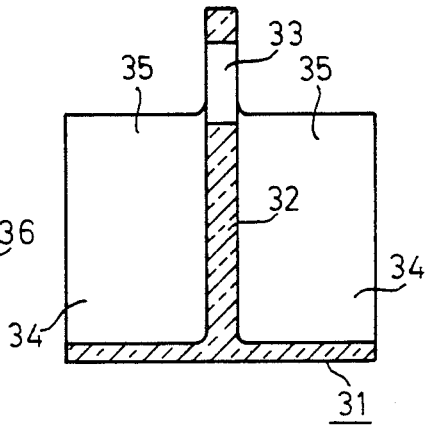
FIG. 3 shows a section 3—3 of the spacer of FIG. 2.

The spacer 31 shown in detail in FIGS. 2 and 3 is intended for contact arrangements having two parallel current leads per pole and comprises for this purpose, besides a wall portion 32 separating the adjacent current leads, two projections 34 contiguous on both sides. These spacers can analogously be employed also for contact arrangements with more than two parallel current paths; for example, for four parallel current paths two identical spacers 31 according to FIG. 2 and 3 can be used in conjunction with a modified spacer to be applied therebetween, which spacer corresponds essentially to the wall portion 32 without the projections 34. For any number of parallel current paths, spacers corresponding to those of FIGS. 2 and 3 are also usable, with the difference that one of the two projections 34 has been omitted. The insulating property of the spacer can be obtained by coating a metal part or by producing the spacer as a whole from an insulating plastic.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A contract arrangement for a low-voltage circuit breaker having a pivotally mounted holder for a movable switching lever, the movable switching lever being arranged for movement between open and closed positions with respect to a cooperating fixed contact, said movable switching lever being connected by a flexible current lead to a fixed connecting point, said contact arrangement including a parallel arrangement of at least two current leads comprising at least two current paths per pole of the contact arrangement and an insulating spacer supported between the current leads of each pole and disposed on a fixed support.

2. The contact arrangement recited in claim 1, wherein an opening is provided in the spacer for receiving a bearing pin forming a pivot bearing on which the holder is mounted for pivotable motion.

3. The contact arrangement recited in claim 1, wherein the spacer receives looped current leads each having first and second legs, said spacer having a seating surface for one leg of the loop of a current lead and an abutment surface for limiting the mobility of the spacer relative to a fixed stop member of said fixed support whereby a force induced by current in said legs acts so as to bias said abutment surface against the stop member and so as to bias said movable switching lever against said fixed contact.

4. The contact arrangement recited in claim 3, wherein the spacer has a protective arch for the current leads contiguous with the seating surface, said arch having a dimension such that movement of the current leads between open and closed positions of the switching lever is not impeded by said arch, said arch being disposed on a side of said spacer opposite said seating surface.

5. The contact arrangement recited in claim 2, wherein said opening has a larger diameter than said bearing pin.

* * * * *